United States Patent [19]

Bryan

[11] Patent Number: 4,953,702

[45] Date of Patent: Sep. 4, 1990

[54] STACKER DEVICE FOR A PACKAGE

[76] Inventor: Robert M. Bryan, P.O. Box 35664, Minneapolis, Minn. 55435

[21] Appl. No.: 402,223

[22] Filed: Sep. 1, 1989

[51] Int. Cl.[5] ..... B65D 71/08; B65D 5/48; B65D 21/02

[52] U.S. Cl. ..... 206/432; 206/433; 206/503; 206/821; 229/120.25; 229/120.31

[58] Field of Search ..... 206/432, 437, 497, 503, 206/821, 45.33, 427, 428, 431; 229/120.09, 120.25, 120.31

[56] References Cited

U.S. PATENT DOCUMENTS

| | | | |
|---|---|---|---|
| 2,549,801 | 4/1951 | George | 229/120.31 |
| 3,327,919 | 6/1967 | Kim . | |
| 3,580,471 | 5/1971 | Burke | 229/120.31 |
| 3,595,384 | 7/1971 | Sargent et al. . | |
| 3,702,170 | 11/1972 | Adams | 229/120.25 |
| 3,826,357 | 7/1974 | Roth . | |
| 4,062,448 | 11/1977 | Meighan . | |
| 4,119,202 | 10/1978 | Roth | 206/432 |
| 4,223,827 | 9/1980 | Gilbert | 206/433 |
| 4,251,020 | 2/1981 | Schwanner . | |

*Primary Examiner*—George E. Lowrance
*Attorney, Agent, or Firm*—Burd, Bartz & Gutenkauf

[57] ABSTRACT

A stacker device for packages of a plurality of identical plastic or paper containers supported in a tray or box, for the purpose of providing compressive load-bearing capability of the package. The stacker is composed essentially of stiff sheet material laminated together into a unique structure which is collapsible for ease of storage and shipment and feeding into automated packaging equipment. It functions to impart load-bearing strength to the package and serves as a divider or partition for separating at least some of the containers.

18 Claims, 3 Drawing Sheets

STACKER DEVICE FOR A PACKAGE

FIELD OF THE INVENTION

BACKGROUND OF THE INVENTION

This invention relates to a stacker device for packages of a plurality of identical plastic or paper containers supported in a tray or shipping carton for the purpose of providing compressive load-bearing capability to the package. Although not limited thereto, the invention is especially adapted to shrink wrapped packages of a plurality of plastic or paper containers supported in a tray and surrounded by a plastic wrap.

For many goods the packing of multiple containers in a relatively shallow base tray surrounded by a transparent shrinkable plastic wrap, instead of a conventional corrugated cardboard carton, has become commonplace. With the increasing popularity of warehouse-type grocery stores and supermarkets, such packages offer convenience in that upon removal of the plastic wrap, the entire package may be shelved or stacked for display purposes. Where the goods themselves have considerable load-bearing strength, such as canned goods and glass bottled goods, such shrink wrapped packages can readily be stacked. More recently, it has become commonplace to package many goods in lighter weight synthetic resinous plastic containers such as bottles, jugs, and the like. Other goods are packed in paper containers offering little or no load-bearing strength.

Shrink wrapped packages of such lighter weight plastic or paper containers are easier to handle, are cheaper to ship, etc. However, they lack significant compressive load-bearing strength so that, if, stacked too high, one or more of the containers in the lowermost package may rupture. Whether the contained goods are beverages or table syrups or motor oils or cooking oils, an undesirable mess is created which may ruin not only the goods in the package including the ruptured container, but adjacent packages as well. Frangible goods, such as chips and flakes and the like, which are often sold in paper containers, may be rendered unsaleable if crushed. The present invention is directed to the alleviation of these problems. THE PRIOR ART Prior attempts to increase the load-bearing capacity of packages of varying kinds are exemplified by the following U.S. Patents:

| | | |
|---|---|---|
| Kim | 3,327,919 | June 27, 1967 |
| Sargent et al | 3,595,384 | July 27, 1971 |
| Roth | 3,826,357 | July 30, 1974 |
| Meighan | 4,062,448 | December 13, 1977 |
| Schwaner | 4,251,020 | February 17, 1981 |

SUMMARY OF THE INVENTION

The present invention is directed to a package of a plurality of identical plastic or paper containers supported in a tray or box. The stacker device functions to impart load-bearing strength to the package and serves as a divider or partition for separating at least some of the containers. The stacker is composed essentially of stiff sheet material laminated together into a unique structure which is collapsible for ease of storage and shipment and feeding into automated packaging equipment.

The stacker comprises similar first and second rectangular segments each having a relatively narrow end section, a center section, and a relatively wider end section, all connected along parallel vertically extending fold lines and having a width at least equal to the height of the plastic or paper containers to be packaged. The stacker also includes similar third and fourth segments of the same height, which optionally may have a narrow end section connected along a vertically extending fold line. The first and second segments are joined together in first and second laminated joints between the inner surfaces of each of the narrow end sections of those segments and the outermost edge surface of the wider sections of the other of said segments. The third and fourth segments are joined to the composite first and second segments in laminated joints between the outer surface of each of the center sections of the first and second segments and one surface of the third and fourth segments. Where the third and fourth segments have a separate end section, those end sections are joined to the composite structure in fifth and sixth laminated joints between those end sections and the narrow end sections of the first and second segments on the outer surfaces thereof opposite from the first and second laminated joints.

BRIEF DESCRIPTION OF THE DRAWINGS

The invention is illustrated in the accompanying drawings in which corresponding parts are identified by the same numerals and in which.

DETAILED DESCRIPTION OF THE PREFERRED EMBODIMENT

Figure 1:
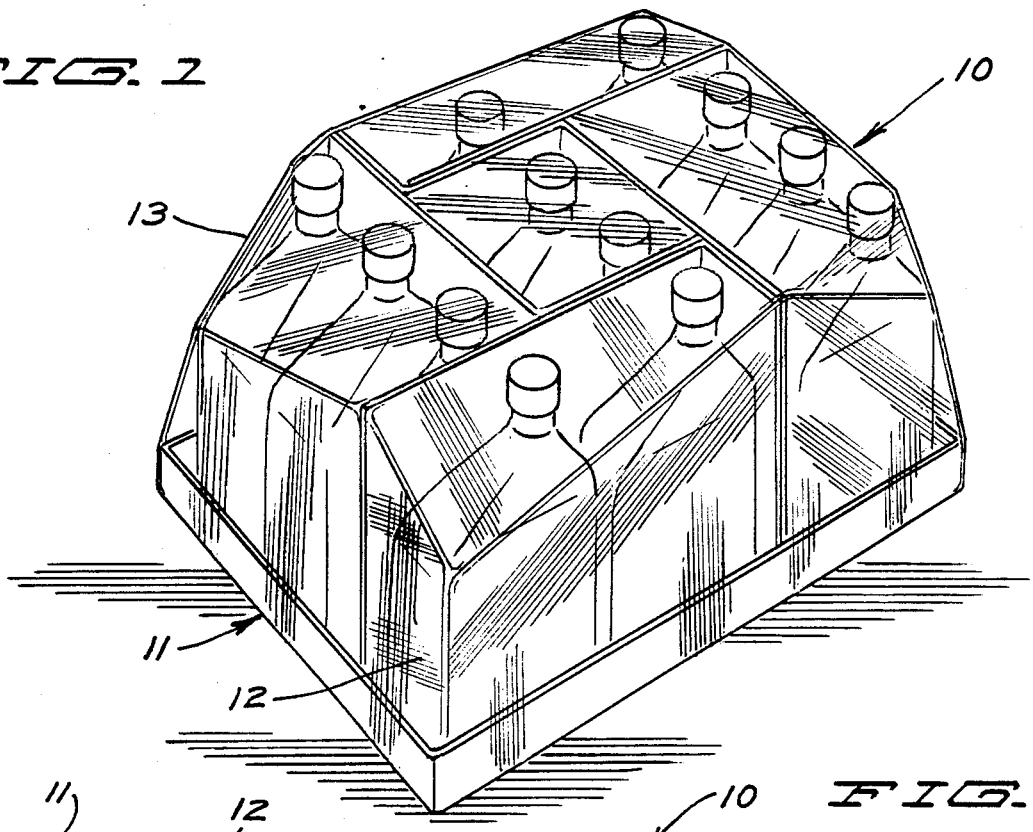
FIG. 1 is a perspective view of a typical shrink wrapped package including a stacker according to the present invention.
Figure 2:
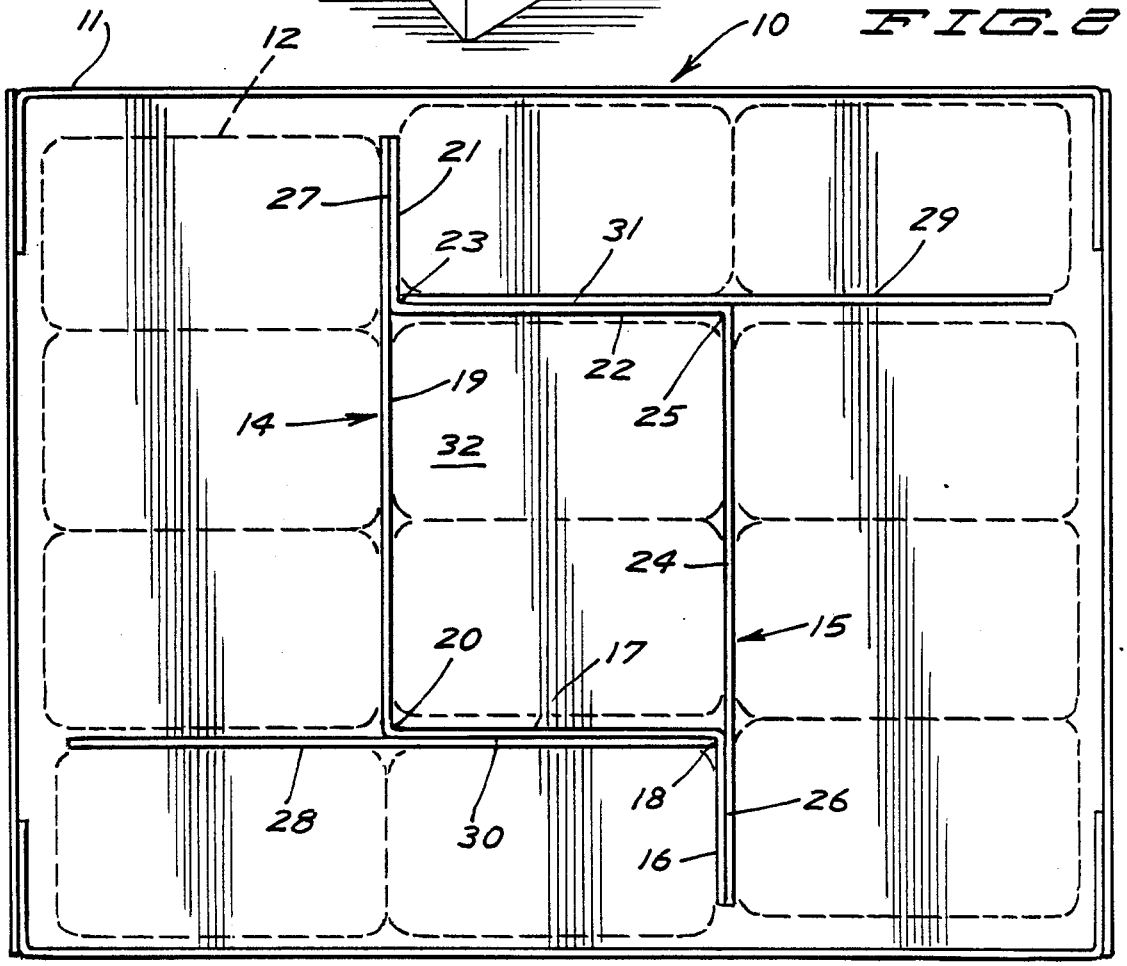
FIG. 2 is a plan view of the paperboard components of such a package showing one configuration of stacker.
Figure 3:
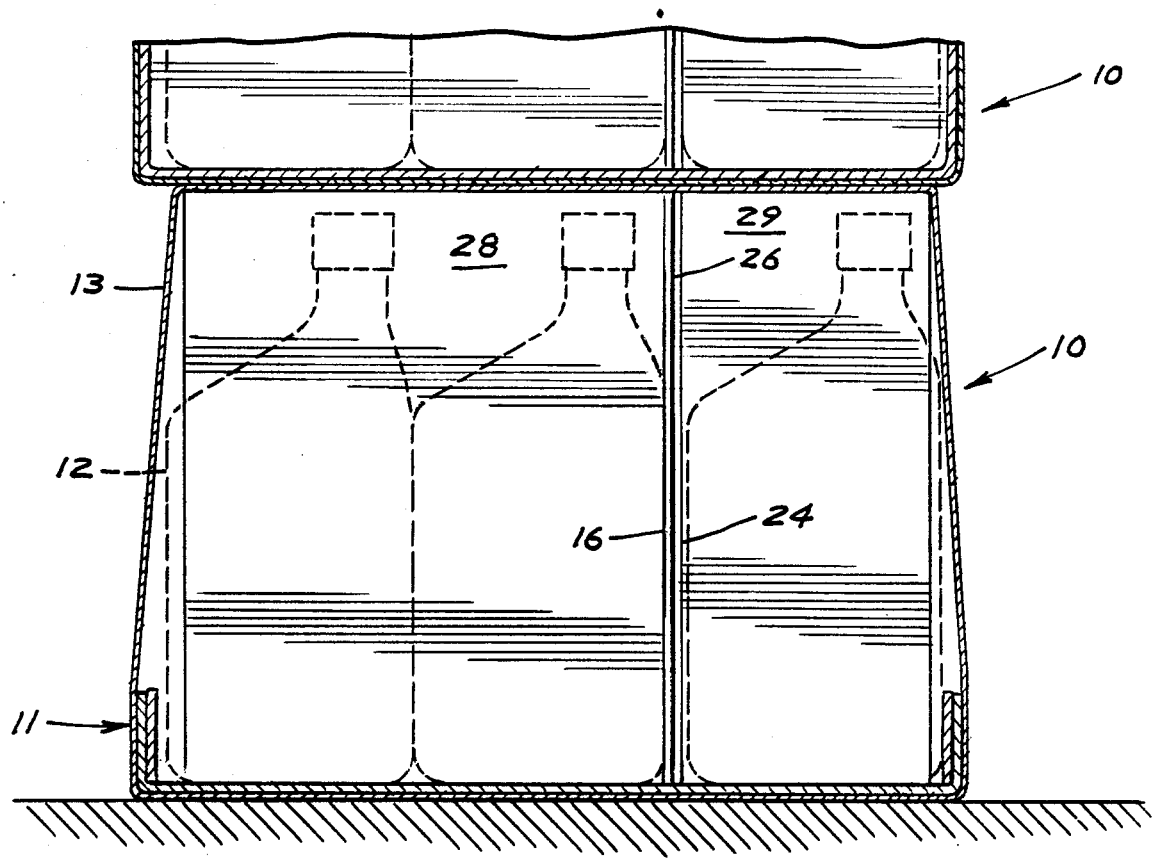
FIG. 3 is an elevation in section on the line 3—3 of FIG. 2 and in the direction of the arrows, and showing two packages stacked one above the other.
Figure 4:
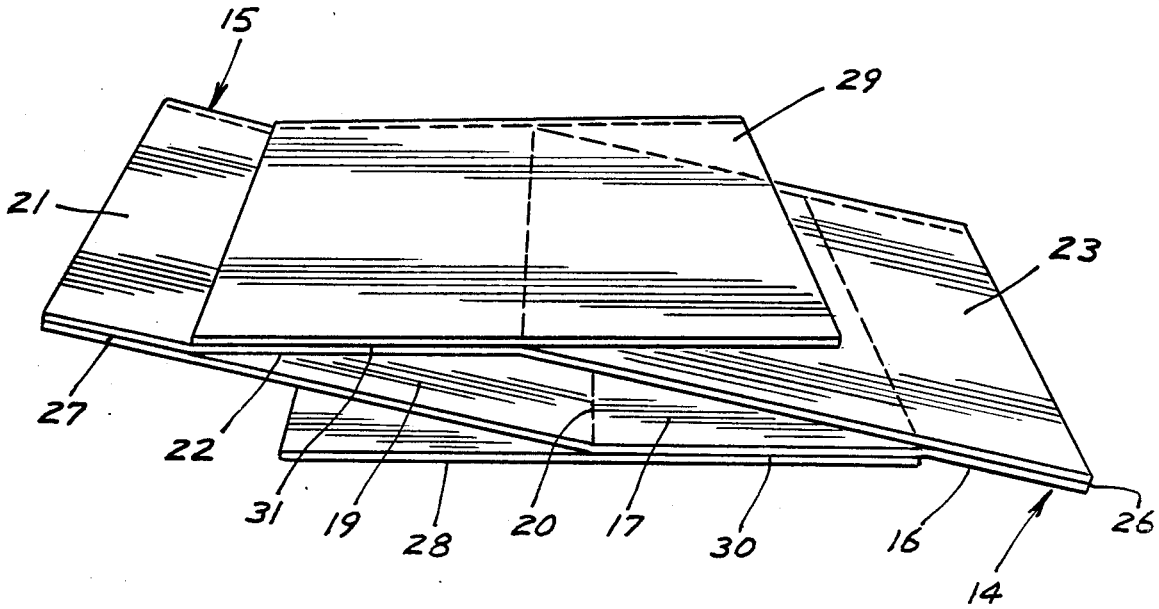
FIG. 4 is a perspective view of the stacker device of FIGS. 1, 2 and 3 in partially collapsed form.

Referring now to the drawings, and particularly to FIGS. 1 through 3, there is shown a typical shrink wrapped package indicated generally at 10. The package 10 includes a standard rectangular shallow paperboard tray 11 having a bottom wall and side and/or end walls. A plurality of identical standard synthetic resinous plastic containers 12 are supported within tray 11, containers 12 as shown being of a type commonly used in the packaging of motor oil. A stacker device, as hereinafter described in detail, rests upon the bottom wall of tray 11 and provides partitioned compartments for containers 12. A shrunken plastic film 13 extends partially or completely around the assembled tray, containers and stacker, as is well known in the art.

The stacker device is composed essentially of similar first and second rectangular segments 14 and 15, respectively, of stiff sheet material, such as corrugated cardboard as is commonly used in the packaging industry. The corrugations extend vertically for maximum strength. Stacker segment 14 includes a relatively narrow end section 16 joined to a center section 17 along a fold line 18 and a relatively wider end section 19 joined to center section 17 along a fold line 20. Similarly, second stacker segment 15 includes a relatively narrow end section 21 joined to a center section 22 along a fold line 23 and a relatively wider end section 24 joined to the center section 22 along a fold line 25. The fold lines are vertically extending and parallel.

The narrow end section 16 of segment 14 is connected to the outermost edge surface of the wider section 24 of stacker segment 15 in a first laminated joint 26. Similarly, the narrow end section 21 of stacker segment 15 is joined to the outermost edge surface of the wider section 19 of stacker segment 14 in a second laminated joint 27.

The stacker also includes third and fourth rectangular stacker segments 28 and 29 composed of stiff paperboard sheet material similar to that of the first and second stacker segments. Third stacker segment 28 is joined to the center section 17 of stacker segment 14 in a third laminated joint 30. Similarly, the fourth stacker segment 29 is joined to the center section 22 of stacker segment 15 in a fourth laminated joint 31. The laminated joints are substantially coextensive in area with the respective parts joined together. The joints are made with glue or other adhesives, as are commonly used in the packaging industry.

The first and second stacker segments 14 and 15 are foldable along the fold lines 18, 20, 23 and 25 into a zig-zag or Z-fold to define a central container-holding space or compartment 32 which is rectangular in the assembled stacker device used in a shrink wrapped package. The elements defining compartment 32 form a strong weight-bearing hollow column, the strength being enhanced by the laminated joints 30 and 31, supplemented by the projecting wing-like columns formed by laminated joints 26 and 27. The first and second laminated joints 26 and 27, respectively, project outwardly in opposite directions from the diagonally opposite corners of the compartment 32. Similarly, the free ends of stacker segments 28 and 29 project outwardly in opposite directions from the other diagonally opposite corners of compartment 32. The height of the assembled stacker is at least equal to that of the containers 12, but preferably about ¼ to ½ inch higher than the height of said containers. The stacker is readily assembled by adaptation of existing automatic packaging equipment.

Standard corrugated shipping boxes and cartons have some inherent load-bearing and stacking capability. This capability may be enhanced to some extent by the inclusion of dividers within the box. It may be enhanced further by the use of the stacker of this invention.

Figure 5:
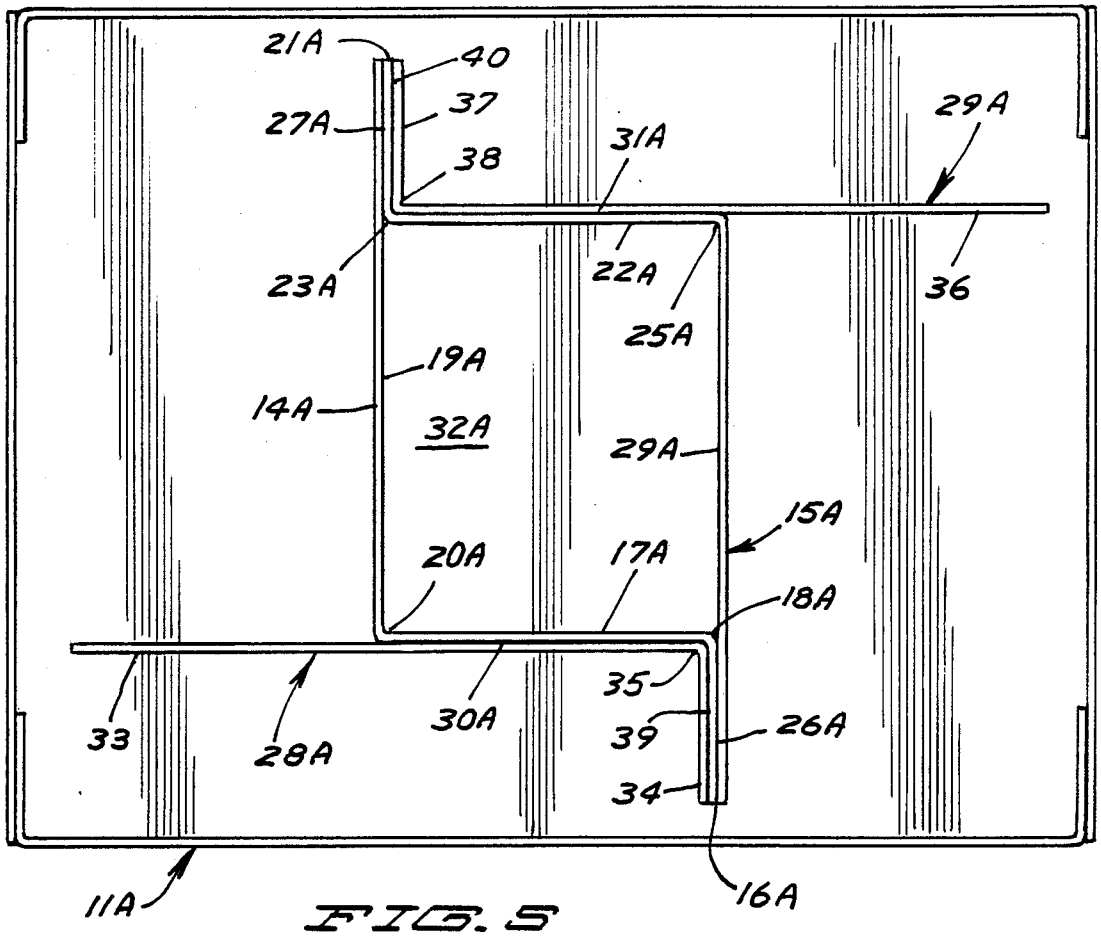
FIG. 5 is a plan view of the paperboard components of a package showing an alternative stacker configuration.

Referring now to FIG. 5, there is shown a plan view of the paperboard components of a package showing an alternative stacker configuration in which the third and fourth stacker segments each have an optional narrow end section as described hereinafter. The package includes a tray 11A as heretofore described. The alternative form of stacker device is composed essentially of similar first and second rectangular segments 14A and 15A. Stacker segment 14A includes a relatively narrow end section 16A joined to a center section 17A along a fold line 18A and a relatively wider end section 19A joined to center section 17A along a fold line 20A. Similarly, second stacker segment 15A includes a relatively narrow end section 21A joined to a center section 22A along a fold line 23A and a relatively wider end section 24A joined to the center section 22A along a fold line 25A.

The narrow end section 16A of segment 14A is connected to the outermost edge surface of the wider section 24A of stacker segment 15A in a first projecting wing-like laminated joint 26A. Similarly, the narrow end section 21A of stacker segment 15A is joined to the outermost edge surface of the wider section 19A of stacker segment 14A in a second laminated joint 27A.

The alternative stacker also includes third and fourth rectangular stacker segments 28A and 29A. Stacker segment 28A has a wide end section 33 and a narrow end section 34 connected along a vertically extending fold line 35 and foldable into an L-fold. Similarly, fourth alternative stacker segment 29A is composed essentially of a wide end section 36 and a narrow end section 37 connected along a vertically extending fold line 38. In the assembled stacker, the end of the wide section 33 of stacker segment 28A adjacent to fold line 35 is joined to the center section 17A of stacker segment 14A in a third laminated joint 30A. The narrow end section 35 of stacker segment 28A is joined to the composite structure of joint 26A in a fifth laminated joint 39 with the opposite surface of narrow end section 16A of stacker segment 14A. Similarly, the end section 36 of alternative stacker segment 29A adjacent to fold line 38 is joined to the center section 22A of stacker segment 15A in a fourth laminated joint 31A. The narrow end section 37 of stacker segment 29A is joined to the composite structure of joint 27A in a sixth laminated joint 40 with the opposite surface of narrow end section 21A of stacker segment 15A. The stacker components defining central compartment 32A form a strong weight-bearing hollow column by virtue of the laminated joints 31A and 32A. This strength is enhanced by the auxiliary projecting wing-like columns formed by the composite laminated joints 26A and 39 and 27A and 40, respectively. The free ends of the wider end sections 33 and 36 of alternative stacker segments 28A and 28B, respectively, project outwardly from the diagonally opposite corners of compartment 32A to position the stacker within the tray and provide compartments for the packaged containers. This alternative form of stacker is collapsible, as previously described, and may also be used in standard shipping cartons to enhance their load-bearing capability.

Figure 6:
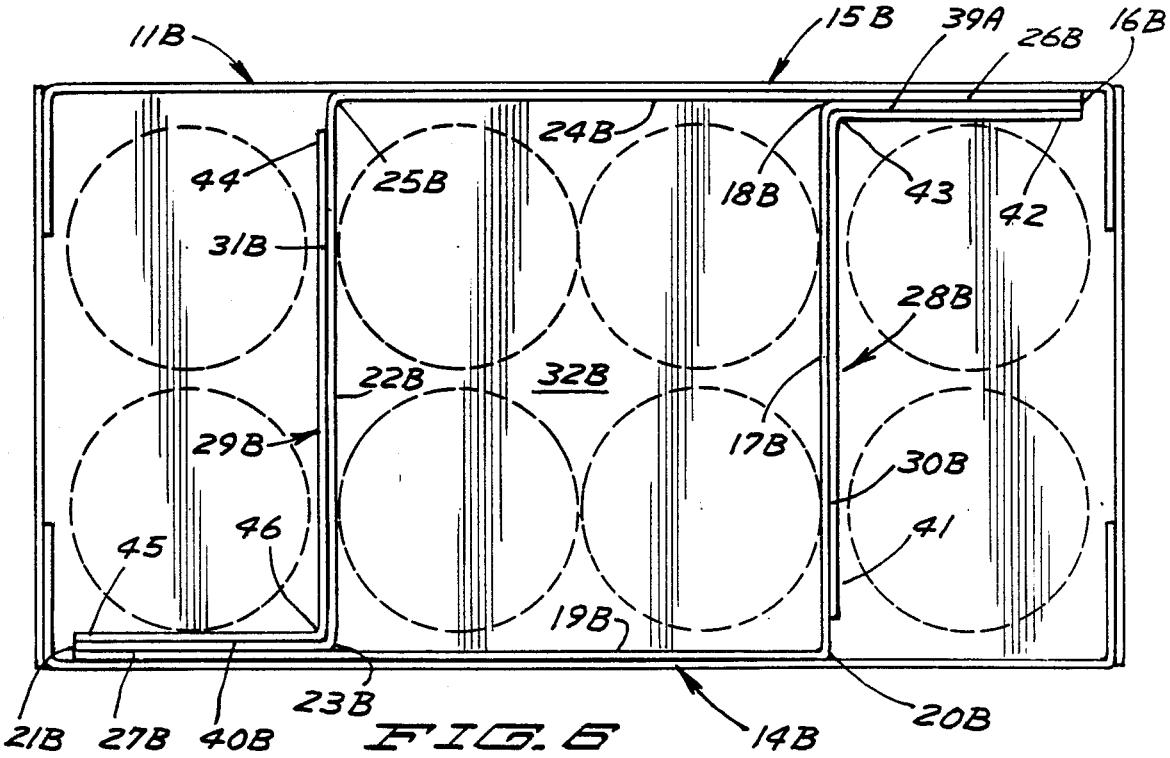
FIG. 6 is a plan view of the paperboard components of a package showing a still further stacker configuration.

Referring now to FIG. 6, there is shown a plan view of the paperboard components of a package showing a further alternative form of stacker configuration. The package includes a shallow tray 11B as heretofore described. The alternative stacker device is composed essentially of similar first and second rectangular segments 14B and 15B. Alternative stacker segment 14B includes a relatively narrow end section 16B joined to a center section 17B along a fold line 18B and a relatively wider end section 19B joined to center section 17B along a fold line 20B. Similarly, alternative second stacker segment 15B includes a relatively narrow end section 21B joined to a center section 22B along a fold line 23B and a relatively wider end section 24B joined to the center section 22B along a fold line 25B.

The narrow end section 16B of alternative segment 14B is connected to the outermost edge surface of the wider section 24B of alternative stacker segment 15B in a first projecting wing-like laminated joint 26B. Similarly, the narrow end section 21B of alternative stacker segment 15B is joined to the outermost edge surface of the wider section 19B of alternative stacker segment 14B in a second laminated joint 27B.

The alternative stacker also includes third and fourth rectangular stacker segments 28B and 29B. Third stacker segment 28B is composed of a relatively wider end section 41 and a relatively narrower end section 42 connected along a fold line 43 and foldable into an L-fold. Similarly, the fourth alternative stacker segment 29B has a relatively wider end section 44 and a relatively narrower end section 45 joined along fold line 46.

The relatively wider section 41 of alternative stacker segment 28B is joined to the center section 17B of alternative stacker segment 14B in a third laminated joint 30B. Similarly, the wider end section 44 of the fourth alternative stacker segment 29B is joined to the center section 22B of alternative stacker segment 15B in a fourth laminated joint 31B. The narrower end section 42 of alternative stacker segment 28B is joined to the narrow end section 16B of stacker segment 14B in a fifth laminated joint 39A. Similarly, the narrow end section 45 of alternative stacker segment 29B is joined to the narrow end section 21B of stacker segment 15B in a sixth laminated joint 40A.

In this alternative form of stacker device, the width of the hollow column formed by the stacker elements defining compartment 32B is essentially the width of the inside of tray 11B so that the stacker fits therein with a loose slide fit. Thus, the third and fourth stacker segments 28B and 29B do not have wings extending beyond the limits of the central column, as in the other forms of stacker device. As in the other forms of stacker device, the stacker elements defining compartment 32 form a strong weight-bearing hollow column whose strength is enhanced by laminated joints 30B and 31B. The strength of the stacker is further enhanced by the outwardly projecting composite columns formed by laminated joints 26B and 39A, and 27B and 40A, respectively. This alternative form of stacker is collapsible, as previously described, and may also be used in shipping cartons or boxes.

It is apparent that many modifications and variations of this invention as hereinbefore set forth may be made without departing from the spirit and scope thereof. The specific embodiments described are given by way of example only and the invention is limited only by the terms of the appended claims.

What is claimed:

1. A stacker device for a package of a plurality of identical plastic or paper containers supported in a tray or box, said device comprising:
   (A) a first rectangular segment of stiff sheet material having a relatively narrow end section, a center section and a relatively wider end section connected along parallel vertically extending fold lines, the width of said sheet material being at least equal to the height of the plastic or paper containers to be packaged,
   (B) a second rectangular segment of stiff sheet material similar to said first segment,
   (C) a third and fourth rectangular segment of stiff sheet material, the height of said segments being the same as the height of said first and second segments,
   (D) first and second laminated joints between the inner surfaces of each of the narrow end sections of said first and second segments and the outermost edge surface of the wider end sections of the other of said segments, and
   (E) third and fourth laminated joints between the outer surface of each of the center sections of said first and second segments and one end of one of said third and fourth segments.

2. A stacker according to claim 1 wherein:
   (A) said first and second joints are approximately coextensive in area with the narrow end sections of said first and second segments, and
   (B) said third and fourth joints are approximately coextensive in area with the center sections of the first and second segments.

3. A stacker according to claim 1 wherein:
   (A) said first and second segments are foldable along said fold lines into a zig-zag or Z-fold to define a central container-holding space and projecting load support elements, and
   (B) said first and second joints project outwardly in opposite directions from the diagonally opposite corners of said space.

4. A stacker according to claim 3 wherein said segments are collapsible into a flat body four segments thick.

5. A stacker according to claim 3 wherein, when said container-holding space is rectangular, the overall length and width of said assembled segments correspond generally to the length and width of the tray supporting the containers so as to fit loosely within said tray.

6. A stacker according to claim 3 wherein:
   (A) the widths of said third and fourth segments are greater than the width of the center sections of the first and second segments, and
   (B) the free unlaminated ends of said third and fourth segments project outwardly in opposite directions from the other diagonally opposite corners of the container-holding space.

7. A stacker according to claim 1 wherein:
   (A) said third and fourth segments of sheet material each have a narrow end section connected thereto along a vertically extending fold line, and
   (B) said narrow end sections are laminated in fifth and sixth laminated joints to the narrow end sections of said first and second segments on the outer surfaces thereof opposite from the first and second laminated joints.

8. A stacker according to claim 7 wherein said third and fourth segments are foldable along said fold lines into an L-fold.

9. A stacker according to claim 1 wherein said segments of sheet material are composed of corrugated paperboard, the corrugations thereof extending vertically.

10. A stacker device for a package of a plurality of identical plastic or paper containers supported in a tray or box, said device comprising:
   (A) a first rectangular segment of stiff sheet material having a relatively narrow end section, a center section and a relatively wider end section connected along parallel vertically extending fold lines, the width of said sheet material being at least equal to the height of the plastic or paper containers to be packaged,
   (B) a second rectangular segment of stiff sheet material similar to said first segment,
   (C) a third rectangular segment of stiff sheet material having a narrow end section connected thereto along a vertically extending fold line, the height of said segment and end section being the same as the height of said first and second segments, (D) a fourth rectangular segment of stiff sheet material similar to said third segment, (E) first and second laminated joints between the inner surfaces of each of the narrow end sections of said first and second segments and the outermost edge surface of the wider end sections of the other of said segments, (F) third and fourth laminated joints between the outer surface of each of the center sections of said first and second segments and one end of one of said third and fourth segments, and (G) fifth and sixth laminated joints between the narrow end sections of said third and fourth segments and the narrow end sections of said first and second segments on the opposite surfaces thereof opposite from the first and second laminated joints.

11. A stacker according to claim 10 wherein:

(A) said first and second joints are approximately coextensive in area with the narrow sections of said first and second segments, (B) said third and fourth joints are approximately coextensive in area with the center sections of the first and second segments, and (C) said fifth and sixth joints are approximately coextensive in area with the end sections of the third and fourth segments.

12. A stacker according to claim 10 wherein:

(A) said first and second segments are foldable along said fold lines into a zig-zag or Z-fold to define a central container-holding space and projecting load support elements, (B) said third and fourth segments are foldable along said fold lines into an L-fold, and (C) said first, second, fifth and sixth joints project outwardly in opposite directions from the diagonally opposite corners of said space.

13. A stacker according to claim 12 wherein said segments are collapsible into a flat body four segments thick.

14. A stacker according to claim 12 wherein, when said container-holding space is rectangular, the overall length and width of said assembled segments correspond generally to the length and width of the tray supporting the containers so as to fit loosely within said tray.

15. A stacker according to claim 12 wherein:

(A) the widths of said third and fourth segments are greater than the width of the center sections of the first and second segments, and (B) the free unlaminated ends of said third and fourth segments project outwardly in opposite directions from the other diagonally opposite corners of the container-holding space.

16. A stacker according to claim 10 wherein said segments of sheet material are composed of corrugated paperboard, the corrugations thereof extending vertically.

17. In combination:

(A) a flat shallow rectangular base tray having a bottom wall and low side walls, (B) a stacker according to claim 5 within said tray, (C) a plurality of identical plastic or paper containers supported on said tray within the container-holding space within the stacker and between the stacker and tray side walls, and (D) a plastic shrink wrap surrounding said tray, stacker and containers.

18. In combination:

(A) a flat shallow rectangular base tray having a bottom wall and low side walls, (B) a stacker according to claim 14 within said tray, (C) a plurality of identical plastic or paper containers supported on said tray within the container-holding space within the stacker and between the stacker and tray side walls, and (D) a plastic shrink wrap surrounding said tray, stacker and containers.

* * * * *